US006316888B1

(12) United States Patent
Raiser

(10) Patent No.: US 6,316,888 B1
(45) Date of Patent: Nov. 13, 2001

(54) BALLAST FOR AT LEAST ONE GAS DISCHARGE LAMP AND METHOD FOR OPERATING SUCH A BALLAST

(75) Inventor: Franz Raiser, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/720,055

(22) PCT Filed: Apr. 19, 2000

(86) PCT No.: PCT/DE00/01226

§ 371 Date: Dec. 20, 2000

§ 102(e) Date: Dec. 20, 2000

(87) PCT Pub. No.: WO00/70921

PCT Pub. Date: Nov. 23, 2000

(30) Foreign Application Priority Data

May 12, 1999 (DE) ..... 199 22 039

(51) Int. Cl.[7] ..... G05F 1/00

(52) U.S. Cl. ..... 315/307; 315/291; 315/98; 315/209 R; 315/DIG. 4; 315/DIG. 7

(58) Field of Search ..... 315/291, 307, 315/98, 105, 209 R, 194, DIG. 4, DIG. 7

(56) References Cited

U.S. PATENT DOCUMENTS

| | | | | |
|---|---|---|---|---|
| 4,388,563 | | 6/1983 | Hyltin | 315/205 |
| 4,682,080 | * | 7/1987 | Ogawa et al. | 315/209 R |
| 4,725,762 | * | 2/1988 | Jagschitz | 315/226 |
| 4,920,299 | | 4/1990 | Presz et al. | 315/98 |
| 5,103,138 | | 4/1992 | Orenstein et al. | 315/209 R |
| 5,365,151 | * | 11/1994 | Spiegel et al. | 315/209 R |
| 5,367,225 | | 11/1994 | Pacholok et al. | 315/219 |
| 5,485,061 | * | 1/1996 | Ukita et al. | 315/307 |
| 5,583,402 | | 12/1996 | Moisin et al. | 315/307 |
| 6,140,771 | * | 10/2000 | Luger et al. | 315/101 |

FOREIGN PATENT DOCUMENTS

| | | | |
|---|---|---|---|
| 43 32 059 | | 3/1994 | (DE) . |
| 0 306 086 | | 3/1989 | (EP) . |
| 2.067.690 | | 8/1971 | (FR) . |
| 94/06261 | * | 3/1994 | (WO) . |
| 99/01013 | | 1/1999 | (WO) . |

* cited by examiner

*Primary Examiner*—Haissa Philogene
(74) *Attorney, Agent, or Firm*—Carlo S.. Bessone

(57) ABSTRACT

A ballast for a gas discharge lamp having an inverter. A DC voltage source feeds the ballast. A bridge circuit is arranged in parallel with the DC voltage source. The bridge circuit has first and second controllable switches. The midpoint of the bridge is connected to a load circuit having the gas discharge lamp. The gas discharge lamp has first and second electrodes. A control circuit controls the pulse duty factor of the first and second switches. The pulse duty factor is not equal to 50%. The control circuit controls the pulse duty factor such that the first and second electrodes are subjected to essentially the same thermal load on average.

14 Claims, 3 Drawing Sheets

BALLAST FOR AT LEAST ONE GAS DISCHARGE LAMP AND METHOD FOR OPERATING SUCH A BALLAST

TECHNICAL FIELD

The present invention relates to a ballast for at least one gas discharge lamp and to a method for operating a ballast for at least one gas discharge lamp.

PRIOR ART

Such a ballast and such a method are disclosed in WO 94/06261. FIGS. 2*a* and 2*b* illustrated there show the control signals of the two switches in the undimmed operating state, that is to say when maximum power is being fed to the gas discharge lamp, while FIGS. 3*a* and 3*b* there show the control signals of the two switches in the dimmed operating state, that is to say when reduced power is being fed. The pulse duty factor, which is mentioned several times below, may be defined as a quotient of the time interval in which the control signal assumes the high voltage value, and the sum of the periods of the high and the low voltage values, referred to a pulse period. It may be seen that the pulse duty factor of one switch has been changed and, specifically, has been reduced in this case starting from a value of 50% in accordance with FIG. 2*a* there, to a value of less than 50%. However, it has emerged in practice that the gas discharge lamp can shine unevenly, particularly at low temperatures, if the switches are operated in accordance with FIGS. 3*a* and 3*b* of the citation. This is undesirable, for example, when gas discharge lamps are used as exterior lighting.

SUMMARY OF THE INVENTION

It is therefore the object of the present invention to develop a ballast of the type mentioned at the beginning in such a way that this disadvantage is avoided.

A further object of the present invention consists in developing a method for operating a ballast of the type mentioned at the beginning in such a way that uneven shining of the gas discharge lamp is prevented.

The invention is based on the finding that dimmed operation with the aid of control signals provided by the control circuit in accordance with FIGS. 3*a* and 3*b* from WO 94/06261 leads to a different temperature of the two lamp electrodes. As experiments have shown, uneven shining no longer occurs when the two electrodes of the gas discharge lamp are subjected to essentially the same thermal load.

The solution according to the invention offers not only advantages in the case of dimmed operation of a gas discharge lamp—rather, it can also be used for the purpose of making a prescribed ballast available by varying the pulse duty factor in an inventive way for operating the most varied gas discharge lamps with completely different lamp parameters, in particular lamp powers. In other words, a ballast is dimensioned such that for the purpose of operating the gas discharge lamp, which requires maximum power, it works with a pulse duty factor of 50%. All other lamps which are to be operated with the same ballast are then operated with a pulse duty factor of less than 50% without fear of these lamps shining unevenly.

In one embodiment of the solution according to the invention, the first and second switches are operated in a push-pull fashion, that is to say while one switch is receiving an input signal at a high level, the other switch is receiving one at a low level, and vice versa. In a development of the basic idea of the invention, it is then possible to provide that the pulse duty factor of the two switches is changed periodically with the aid of the control circuit. This is preferably to be seen in that the pulse duty factor is controlled with the aid of the control circuit such that the sum of the ON times of the first switch is the same on average as the sum of the ON times of the second switch.

It can be provided in a particularly advantageous way that the first and second switches are operated with N different pulse duty factors, in which case $N \geqq 2$ and the change between the different pulse duty factors is performed with a period which is determined in the shortest case by virtue of the fact that each pulse duty factor is carried out only precisely once before a change is made to the next one, and which is determined in the longest case by the thermal inertia of the first and second electrodes. The reason for the last-named limit is that it is impermissible to maintain a pulse duty factor until the two electrodes acquire markedly different thermal loads. The result here is different time periods, depending on the physical properties of the electrodes with which a gas discharge lamp is fitted.

N=2 in the case of a concrete exemplary embodiment, the first pulse duty factor being D and the second pulse duty factor being E=100%−D.

While it is possible in the case of the above-named field of use of the invention, that is to say a ballast for gas discharge lamps of different powers, to use the control circuit to store the pulse duty factor appropriate for the respective lamp, it is possible over and above this also to provide an input of the control circuit via which the pulse duty factor can be changed by an operator, for example in order to dim the gas discharge lamp.

DESCRIPTION OF THE DRAWINGS

An exemplary embodiment is explained in more detail below with reference to the enclosed drawings, in which.

DETAILED DESCRIPTION OF THE INVENTION

Figure 1:
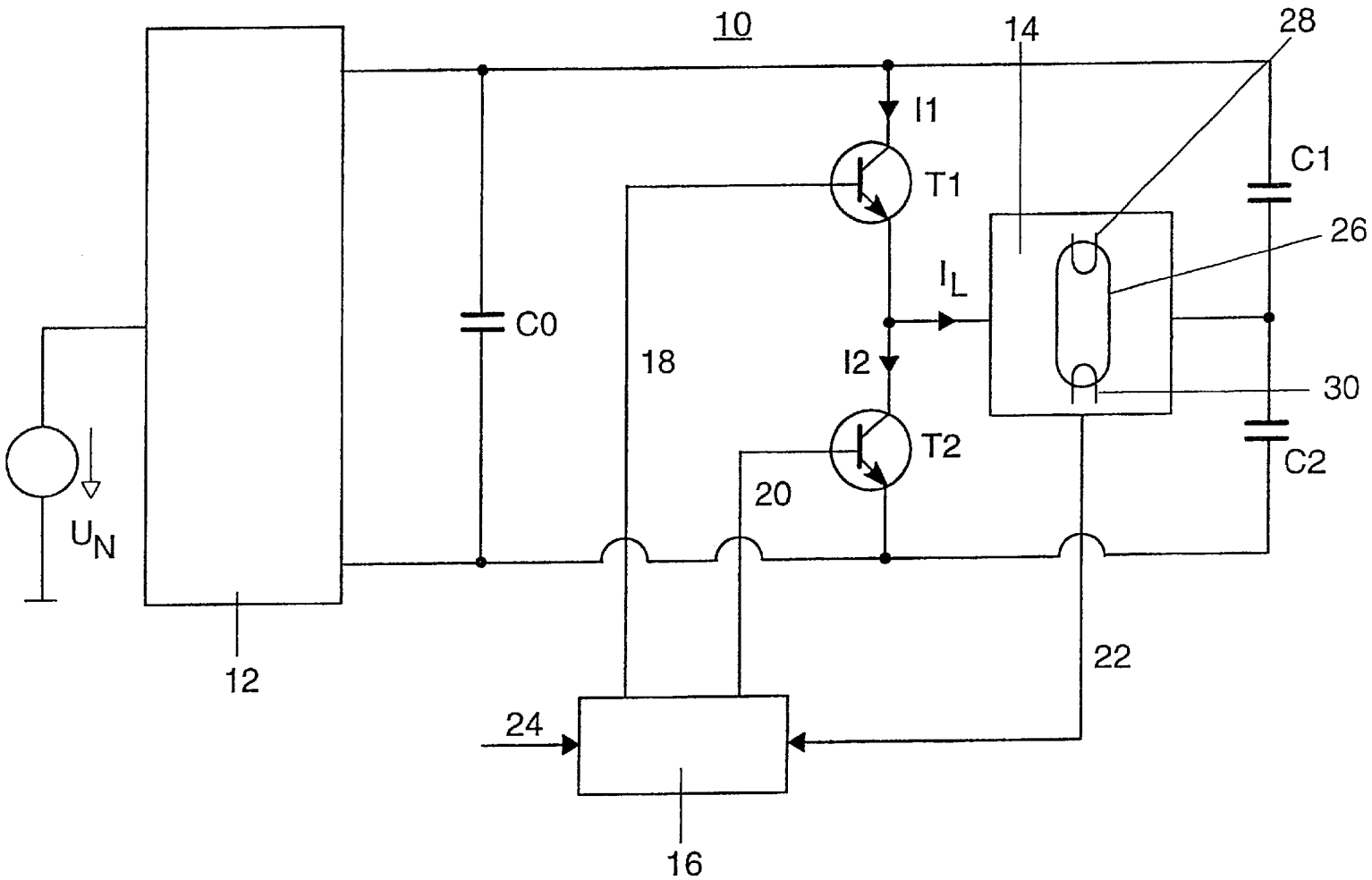
FIG. 1 shows the design of a ballast according to the invention, in schematic form.

FIG. 1 shows a ballast 10 according to the invention, having a module 12 which is connected on the input side to a mains voltage source $U_N$, and comprises a rectifier, filters known to the person skilled in the art, and, if appropriate, also devices for correcting the mains-side power factor. The DC voltage signal provided by the module 12 is stabilized via a capacitor CO and applied to a bridge circuit with the aid of a switch T1 and a switch T2. The midpoint of the bridge is connected to the load circuit 14, which comprises a gas discharge lamp 26 with a first and a second electrode 28, 30.

In accordance with the exemplary embodiment in FIG. 1, the switches T1 and T2 form a half-bridge arrangement together with the capacitors C1 and C2. A control circuit 16 supplies the control signals for the switches T1 and T2 via lines 18 and 20, respectively. The control circuit 16 can be provided via a line 22 with lamp data, for example data on the current power converted in the lamp, and on the lamp current, which can be taken into account in generating the control signals applied to the switches T1 and T2 via the lines 18 and 20. The control circuit 16 can have a microcontroller in which the configuration of the control signals provided for the switches T1 and T2 via the lines 18, 20 is stored, for example for the purpose of operating the respective gas discharge lamp 26 at maximum power. For the case in which dimming of the gas discharge lamp is intended, it is possible as an option to use a line 24 to feed the control circuit with an input signal with the aid of which an operator can influence the control signals of the switches T1 and T2, for example by actuating a rotary button or the like to dim the gas discharge lamp 26. The control signals provided by the control circuit 16 via the lines 18 and 20 are described in more detail below with reference to FIGS. 2 and 3.

Figure 2:
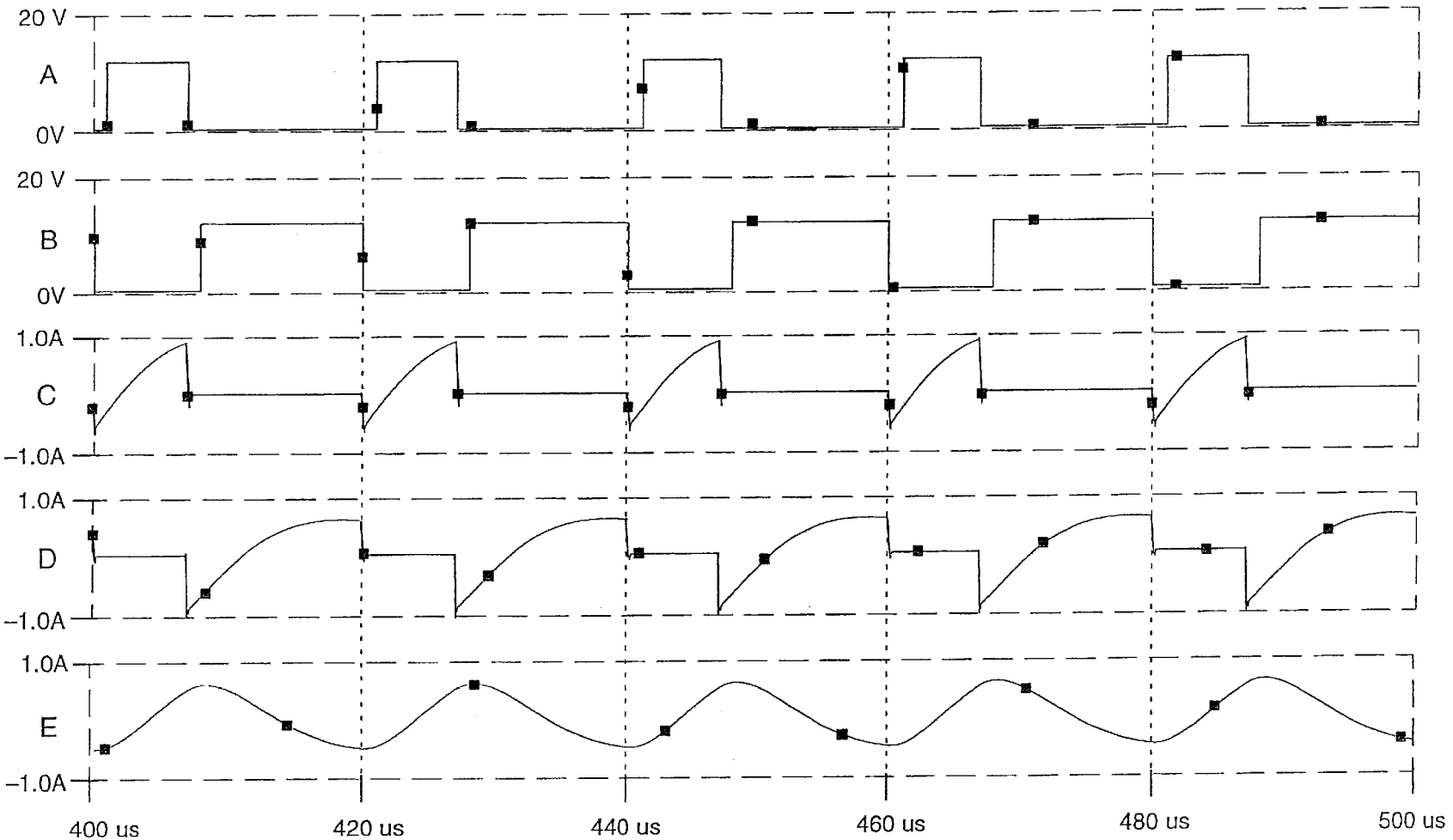
FIG. 2 shows the temporal characteristic of various signals of a ballast operated according to the teaching of the prior art, in schematic form.

FIG. 2 firstly shows in the curves A and B the temporal characteristic of the control signals of the first and second switches T1, T2 in accordance with the teaching of the prior art. Switch T1 is operated in accordance with curve A with a pulse duty factor of 30%. Switch T2 is operated in accordance with curve B with a pulse duty factor of 70%. The curves C and D show the temporal characteristics of the associated currents I1 and I2 through the switch T1 and through the switch T2, respectively. Curve E shows the temporal characteristic of the load current $I_L$. The different lengths of the ON times of switch T1 and switch T2 produce different currents through electrodes 28, 30 of the gas discharge lamp 26, depending on whether switch T1 or T2 is in the ON state. This leads to an uneven thermal loading of the electrodes 28, 30 of the gas discharge lamp 26.

Figure 3:
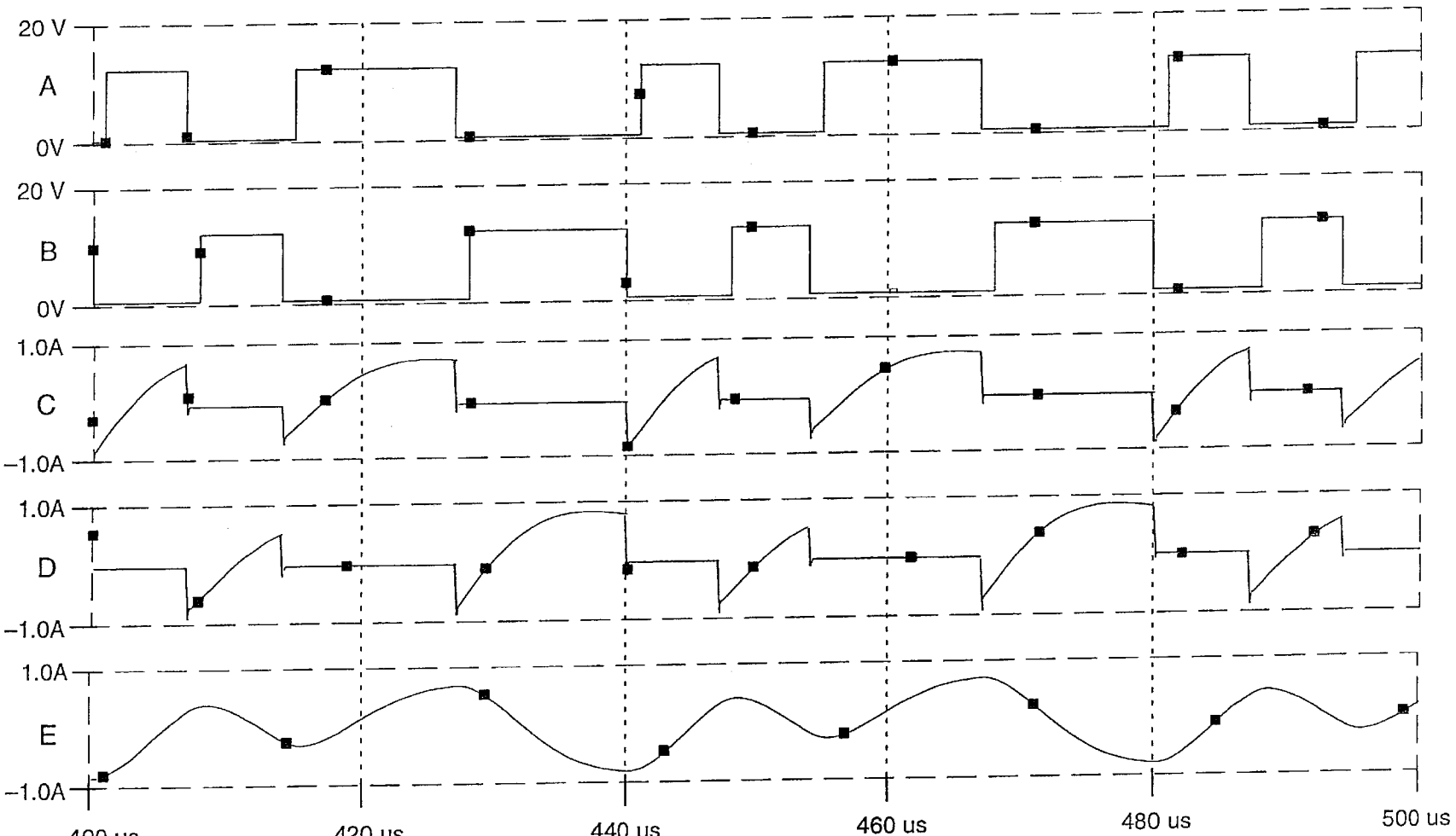
FIG. 3 shows the temporal characteristic of different signals of a ballast in accordance with the present invention, and of a ballast which is operated in accordance with the method according to the invention, in schematic form.

FIG. 3 shows, in the manner corresponding to FIG. 2, the temporal characteristic of the same circuit parameters in conjunction with modification of the ballast in accordance with the teaching of the invention. The two switches T1 and T2 are operated in a push-pull fashion, that is to say, with the exception of switchover operations which are to be neglected, a signal with a high level is applied as control signal to one switch, while a control signal with a low level is applied to the other switch, and vice versa.

Curve A will firstly be considered. Whereas the switch T1 is operated with a pulse duty factor of 70% between the instants t1 and t2, at the instant t2 the control circuit 16 changes the pulse duty factor to 30%. This pulse duty factor is maintained up to the instant t3, after which a change is made, in turn, to a pulse duty factor of 70%. With reference to curve B of FIG. 3, switch T2 is operated with the corresponding inverse pulse duty factor, that is to say with a pulse duty factor of 70% between the instants t2 and t3, and a pulse duty factor of 70% follows once again after t3. Curves C, D and E show, in turn, the temporal characteristics of the currents I1, I2 and of the load current $I_L$.

While a switchover is made in the exemplary embodiment in accordance with FIG. 3 between two pulse duty factors, that is to say a pulse duty factor of 70% and a pulse duty factor of 30%, implementations are also conceivable in which a switchover is mad e between a plurality of pulse duty factors.

FIG. 3 shows a switchover or change from one pulse duty factor to an other immediately after traversal of a pulse period of a specific pulse duty factor. However, it can also be provided to maintain a specific pulse duty factor over a longer time period before switching over to the next pulse duty factor, this being, however, under the condition that no substantially different thermal loads of the two electrodes 28, 30 of the gas discharge lamp 26 arise. The instant at which it is necessary to switch over to another pulse duty factor at the latest depends occasionally on the physical properties of the electrodes used in the respective gas discharge lamp. Switching over from one pulse duty factor to another not directly after a single execution of a specific pulse duty factor has the advantage that it is possible to make use in the control circuit 16 of components which are designed for lower frequencies and are therefore less expensive. It is possible, for example, to make use of a more favorable microcontroller, since a smaller quantity of data need be processed in the case of longer switchover times.

It is obvious to the person skilled in the art that the present invention can also be used in the case of ballasts with a full bridge arrangement, it being possible then to provide that the control circuit 16 provides two further control signals for the two further switches.

The described circuit can be used not only for externally controlled, but also for freely oscillating inverters.

Bipolar transistors were selected by way of example as switches in FIG. 1. It is evident to the person skilled in the art that other types of switches, for example field effect transistors, also come into consideration.

What is claimed is:

1. A ballast for a gas discharge lamp, comprising:

an inverter;

a DC voltage source feeding said inverter;

a bridge circuit arranged in parallel with said DC voltage source, comprising first and second controllable switches;

a load circuit connected to a midpoint of said bridge circuit and comprising the gas discharge lamp, said gas discharge lamp having first and second electrodes; and a control circuit controlling a pulse duty factor of said first and second switches, said pulse duty factor not being equal to 50%, said control circuit controlling said pulse duty factor to subject said first and second electrodes to essentially the same thermal load on average.

2. The ballast as claimed in claim 1, wherein said first and the second switches operate in a push-pull fashion.

3. The ballast as claimed in claim 1, wherein said pulse duty factor of said first and second switches changes periodically.

4. The ballast as claimed in claim 3, wherein the sum of the ON times of said first switch is the same on average as the sum of the ON times of said second switch.

5. The ballast as claimed in claim 3, wherein said first and the second switches operate with N different pulse duty factors, N being greater than or equal to 2, and a change between the different pulse duty factors occurs with a period determined, in the shortest case, by each pulse duty factor being carried out only precisely once before a change is made to a next pulse duty factor, and determined, in the longest case, by a thermal inertia of said first and second electrodes.

6. The ballast as claimed in claim 5, wherein N is equal to two, the first pulse duty factor being D and the second pulse duty factor being E=100%−D.

7. The ballast as claimed in claim 1, wherein the control circuit further comprises an input that influences the pulse duty factor.

8. A method for operating a ballast for a gas discharge lamp, the ballast including an inverter, a DC voltage source feeding the inverter, a bridge circuit arranged in parallel with the DC voltage source and comprising first and second controllable switches, a load circuit connected to a midpoint of the bridge circuit and including the gas discharge lamp, the gas discharge lamp having first and second electrodes, and a control circuit controlling a pulse duty factor of the first and second switches, where the pulse duty factor is less than 50%, said method comprising the step of:

controlling the pulse duty factor to subject the first and second electrodes to essentially the same thermal load on average.

9. The method as claimed in claim 8, further comprising the step of operating the first and second switches in a push-pull fashion.

10. The method as claimed in claim 8 further comprising the step of changing the pulse duty factor of the first and second switches periodically.

11. The method as claimed in claim 10, further comprising the step of controlling the pulse duty factor to equate the sum of the ON times of the first switch with the sum of the ON times of the second switch on average.

12. The method as claimed in claim 10, further comprising the step of operating the first and the second switches with N different pulse duty factors, N being greater than or equal to 2, and a change between the different pulse duty factors occurs with a period which is determined, in the shortest case, by virtue of the fact that each pulse duty factor is carried out only precisely once before a change is made to the next one, and which is determined, in the longest case by the thermal inertia of the first and second electrodes.

13. The method as claimed in claim 12, wherein N is equal to two, the first pulse duty factor being D, and the second pulse duty factor being E=100%−D.

14. The method as claimed in claim 8, further comprising the step of feeding the control circuit with an input signal to influence the pulse duty factor.

* * * * *